US009744501B1

(12) United States Patent
Pingitore

(10) Patent No.: US 9,744,501 B1
(45) Date of Patent: Aug. 29, 2017

(54) ARTIFICIAL PLANT HUMIDIFIER

(71) Applicant: Michael Pingitore, Rochester, NY (US)

(72) Inventor: Michael Pingitore, Rochester, NY (US)

( * ) Notice: Subject to any disclaimer, the term of this patent is extended or adjusted under 35 U.S.C. 154(b) by 0 days.

(21) Appl. No.: 15/609,177

(22) Filed: May 31, 2017

(51) Int. Cl.
*B01F 3/04* (2006.01)
*F24F 3/14* (2006.01)

(52) U.S. Cl.
CPC ..... *B01F 3/0407* (2013.01); *F24F 3/14* (2013.01)

(58) Field of Classification Search
CPC ..... B01F 3/04; B01F 3/04021; B01F 3/0407; F24F 3/14
USPC ..... 261/81
See application file for complete search history.

(56) References Cited

U.S. PATENT DOCUMENTS 6,592,053 B2 * 7/2003 Ericksen ..... B05B 17/08 239/16
7,441,756 B2 10/2008 Niedermann
2011/0239538 A1 * 10/2011 Hsu ..... A01G 27/04 47/66.6

* cited by examiner

*Primary Examiner* — Robert A Hopkins
(74) *Attorney, Agent, or Firm* — Vincent G. LoTempio; Kloss, Stenger & LoTempio; David T. Stephenson

(57) ABSTRACT

A decorative humidifier is provided that utilizes the structural features of common houseplants in a new and advantageous ways by providing stalks or stems to form hollow water vapor conduits for humidifying vapor. A planter conceals a water source for the humidifier. Flowers at the end of the stems may serve as water vapor exits. Particular plants may be chosen for advantageous features, such as long and numerous stems and flowers that may serve as an inconspicuous vapor exits. A drying unit may be connected to the vapor tube in order to force dry air through vapor channels to prevent growth of microbes and accumulation of deposits. The natural features of a chosen plant are utilized to create a synergy between aesthetics and function in a decorative humidifier.

20 Claims, 6 Drawing Sheets

ARTIFICIAL PLANT HUMIDIFIER

FIELD

The present disclosure relates to an apparatus for decorative humidifiers, and more specifically to decorative humidifiers designed to conceal the function of the apparatus and appear to be a decorative plant.

RELATED ART

In winter months colder temperatures often lead to a decrease in air humidity. Lower humidity frequently causes discomfort and may lead to medical problems. Common side effects of low humidity include dry skin, lips and eyes, and nasal passages. Symptoms of dry air include itching and flaking skin, as well as blurred vision. Medical treatment for these problems includes the use of creams, ointments and drops. However, these treatments do not address the root cause of problems caused by dry air.

Dry skin, eyes and nasal passages increase the possibility of infection from the common cold, flu and other microorganisms, and irritation from airborne contaminants by damaging the body's natural protective barriers.

Health problems can be significantly exacerbated by mild skin irritations caused by dry air. Longer exposure to dry air can cause inflammation of the mucous membrane lining the respiratory tract. This may increase the severity and duration of the common cold, flu and other viruses. The flu virus can survive longer and spread faster in low humidity settings.

Further, many people report suffering from headaches caused by low humidity, or sinus-related headaches. This is caused by the inflammation of dried sinuses. Nasal sprays are the common relief for such irritations, however, the relief is temporary and side effects from nasal sprays may occur.

To alleviate the discomfort and health problems caused by dry air, many people place humidifiers in high-use areas of their home or office. These types of humidifiers often stand out in a room due to their shape and have an unappealing appearance. They can be in the form of child pleasing creatures or rectangular boxes that do not fit into the aesthetics of most rooms. For example, U.S. Pat. No. 7,441,756 discloses humidifiers that come in various animate and inanimate shapes, including small animals, fruits and sports balls. In addition, most products can only operate for twelve to twenty-four hours before water reservoirs need refilling. Therefore, these humidifiers may require frequent and inconvenient monitoring.

Combinations of humidifiers with objects that may blend in with a home environment are known in the art. For example, U.S. Pat. No. 3,673,770 discloses a furnace register humidifier that resembles an ornamental planter. The artificial plant is comprised of a hydrophilic material that conducts water to all parts of the plants through osmosis. Similarly, U.S. Patent Application No. 20110239538 discloses an artificial plant constructed from a hydrophilic material that conducts water and has a trough that serves as a container for the water source. Additionally, U.S. Pat. Nos. 5,403,233 and 5,672,299 disclose ornamental objects that utilize a hydrophilic material for absorbing water and distributing it by osmosis through a hydrophilic material.

The known art relating to artificial plant humidifiers has both functional and aesthetic limitations. For devices that rely on water distribution through hydrophilic osmosis, artificial plant structures must be constructed of hydrophilic material to absorb and distribute water from the humidifier to air. Therefore, water vapor cannot be directly transmitted from the water source to the surrounding environment. The rate of humidification in these devices is therefore limited to the rate at which water can evaporate from the material. Further, the aesthetic appearance of these devices may be limited due to the specific type of material needed for proper absorption. Additionally, temperature and environmental factors may have an impact on the rate at which humidification occurs.

Therefore, a need exists to provide an aesthetically pleasing humidifier that can blend in with a wide variety of rooms, effectively transmits water vapor from a water source to the surrounding environment, and may operate continuously with limited maintenance.

SUMMARY

The present disclosure overcomes the limitations known in the art by providing a decorative humidifier that uses the structural features of common houseplants in a new and advantageous way by providing stalks or stems that may be constructed of a variety of materials to form hollow water vapor conduits, along with a planter serving as a water source. Flowers or other structural features at the end of the stems may serve as water vapor exits with the present disclosure. Particular plants may be chosen according to the present disclosure that may have a spadix, which may serve as an inconspicuous vapor exit. A drying unit may be connected to the vapor tube in order to allow dry air to flow through the tube to prevent accumulation of deposits.

Existing humidifiers have limitations as to where they can be placed. Many humidifiers cannot be placed on the ground due to the small size of the unit and the level at which the exit port for vapor is located. Many existing humidifiers also have limitations with regard to the materials on which they may be placed, due to condensation effects and the low force of humidity release, to avoid humidity settling on porous materials around the humidifier and potentially damaging the surface. The present disclosure, where artificial reproductions of stems that naturally grow to multiple feet above the surface of the soil may be used as vapor tubes, limits the possibility of vapor condensing on the lower portion of the unit by providing substantial distance between the vapor release point and the lower portion of the unit.

The additional height provided by the use of artificial plants whose natural counterparts may have long stems and flowers at the top of the stem provides an exit port for humidification that is well above floor level, allowing the humidifier to be placed on the floor, or above if desired, without the potential of condensation or damage from low force of humidity release. The design gives more freedom to users in the placement of the artificial plant humidifier of the present disclosure throughout their spaces in the home or office.

In addition, the design offers a large water storage reservoir, while keeping the proper aesthetic. Due to typical dimensions and scales of potted plants and flowers, the water reservoir located in the pot, or planter, can be large, and maximize space due to the typical shape of a pot. This size may offer the potential for several days of operation; well beyond the capacity of a conventional humidifier.

The present disclosure may, in some embodiments, include a UV light to sanitize the water in the storage tank. The design of the humidifier will allow a large storage of water for longer operation, thus resulting in stagnant water for longer than a typical humidifier would incur. The UV light will operate at predetermined intervals to ensure the water is sanitized and all microbial organisms are eliminated.

The present disclosure may, in some embodiments, include a notification light. The notification light may preferably be incorporated into a flower, thereby effectively drawing attention of a user. Alternative locations for the notification light include leaves or the planter. The light may inform a user as to the status of the humidifier. The status provided may include low water levels, humidity setting reached, hours of operation remaining among other indications, and means of signaling may include various colored lights. A notification light according to the present disclosure provides an efficient means for status recognition by a user. Power to the notification light may be provided through a cord that runs through a stem, or structural feature of a plant, or a battery within the notification light. Communication of the status of various conditions may be communicated through a direct line through the stem to sensors, or by wireless connections to sensors.

A filler bottle is also disclosed herein. The high capacity and continuous operation of the present disclosure creates a need for an efficient filling system. The filler bottle works in conjunction with the humidifier to add water to the humidifier without requiring movement of the apparatus. The filler bottle includes a specific connection to the humidifier in order to eliminate spills and hazards when filling. In addition, the humidifier can remain in operation even during the filling process, which is an improvement over conventional humidifiers. A system for filling the artificial pant humidifier without moving the device is important, due to the potentially large size of the tank and the artificial plant.

Embodiments in accordance with the present disclosure may provide an application to be utilized on a device (e.g., computer, phone, tablet, etc.). The application, or app, may provide feedback and features for the end user. Basic functions such as on or off, low water level, and output rate may be available. These same features may be accessible on the base unit itself. However, the app may also allow users an expanded features list. Settings such as room humidity for automatic control, water level warning settings, and notification light colors may be included within the scope of the disclosure. In addition, users may be able to operate and monitor multiple humidifiers from a single device.

Figure 1:
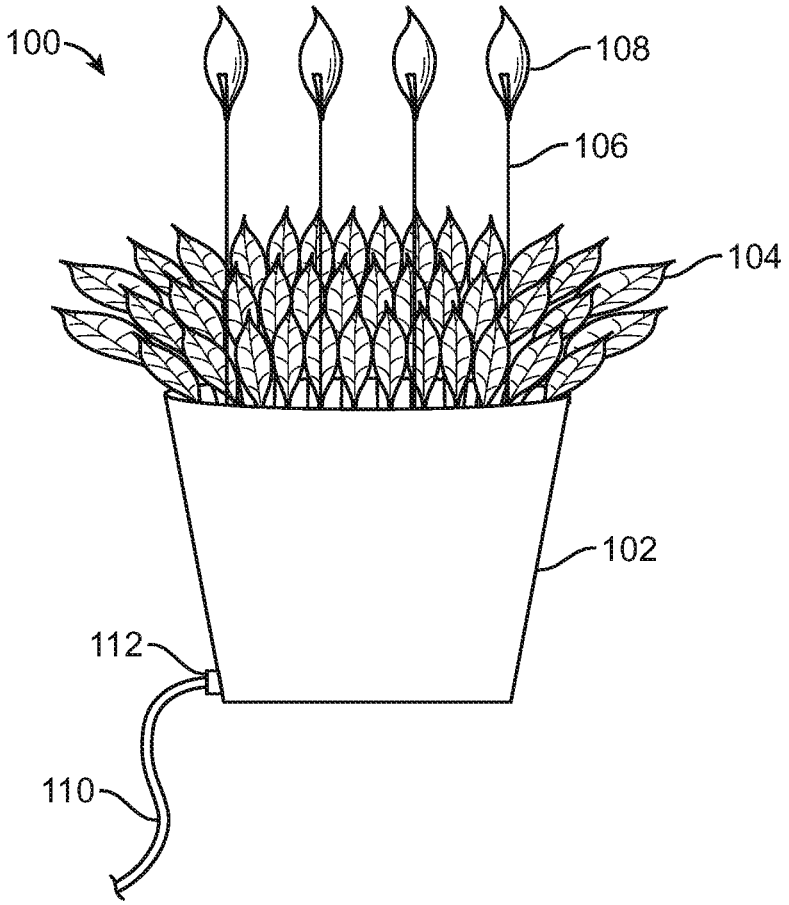
FIG. 1 is front view in accordance with an embodiment of the present disclosure.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

In the following detailed description, numerous specific details are set forth in order to provide a thorough understanding of embodiments or other examples described herein. In some instances, well-known methods, procedures, components and circuits have not been described in detail, so as to not obscure the following description. Further, the examples disclosed are for exemplary purposes only and other examples may be employed in lieu of, or in combination with, the examples disclosed. It should also be noted the examples presented herein should not be construed as limiting of the scope of embodiments of the present disclosure, as other equally effective examples are possible and likely.

The artificial plant with regard to the present disclosure is preferably modeled after a naturally occurring plant having multiple stalks, or stems, that extend from soil to a flower or spadix. Generally, model plants will have multiple stalks which can serve as hollow water vapor conduits and flowers that can contain multiple apertures for water vapor exit. Preferably the flower, or vapor exit feature, will be able to conceal the apertures, as would be the case with a peace lily spadix. Alternatively, a plant may comprise an array of plants, both flowering or not or a mix.

Embodiments in accordance with the present disclosure provide a system for an artificial plant to be combined with a space humidifier to be utilized in the aesthetic fashion of any appropriate plant or flower to enhance the aesthetic and comfort of an interior environment.

FIG. 1 illustrates a front view of an artificial plant humidifier in accordance with an embodiment of the present disclosure. The artificial plant humidifier 100 may be referred to herein as alternatively as a system. Artificial plant humidifier 100 includes a plurality of leaves 104, a plurality of stems 106, and a plurality of flowers 108, all as shown in a general arrangement in a base 102, which may be a planter. Base 102 may include a multitude of shapes, including round, square, and organic styles and may be comprised of various materials, including metals, plastics, and ceramics.

In one embodiment, illustrated in FIG. 1, the artificial plant is a peace lily, although other artificial plants may be used in accordance with the present disclosure. The advantages of a peace lily for use in artificial plant humidifier 100 of the present disclosure include the features of long stems 106, flowers 108 located at the top of the stem 106. Stems 106 serve as a conduit for humidified air which is then released through flowers 108. The length of stems 106 in a peace lily provides height which may be beneficial for circulation of humidified air throughout area to be humidified and for prevention of humidified air condensing on the lower portion of artificial plant humidifier 100.

The height of a stem 106 on a typical peace lily plant will typically measure approximately 24 to 40 inches. In addition, the stems 106 will typically have a diameter of ⅜" to ½". The dimensions of the peace lily stem 106 are conducive for creating a humidifier using an artificial peace lily according to the present disclosure. Creating an artificial plant with a height of thirty-six to forty inches will not only look realistic, but be advantageous for humidification diffusion into a room. The stem 106 size also allows the design to incorporate the humidification flow within; wherein the diameter of the hollow water vapor conduit within stem 106 will be between approximately ⅜" and ½". An artificial plant humidifier 100 with at least four stems 106, each a component of a hollow water vapor conduit 213, will allow sufficient humidified air to be distributed to the surrounding environment while maintaining the realistic appearance of a peace lily plant.

Also illustrated in FIG. 1 are controls 112 and a power cord 110. Controls 112 operate the power on and off as well as additional operations and notifications. Power cord 110 supplies the required voltage and amperage that artificial plant humidifier requires to operate.

Referring to FIG. 1, the power cord 110 and controls 112 are shown in one orientation to the flower 108, however, location of power cord 110 and controls 112 may vary. The dimensions of the components of artificial plant humidifier, including base 102, leaves 104, stems 106, and flowers 108 may vary.

Figure 2:
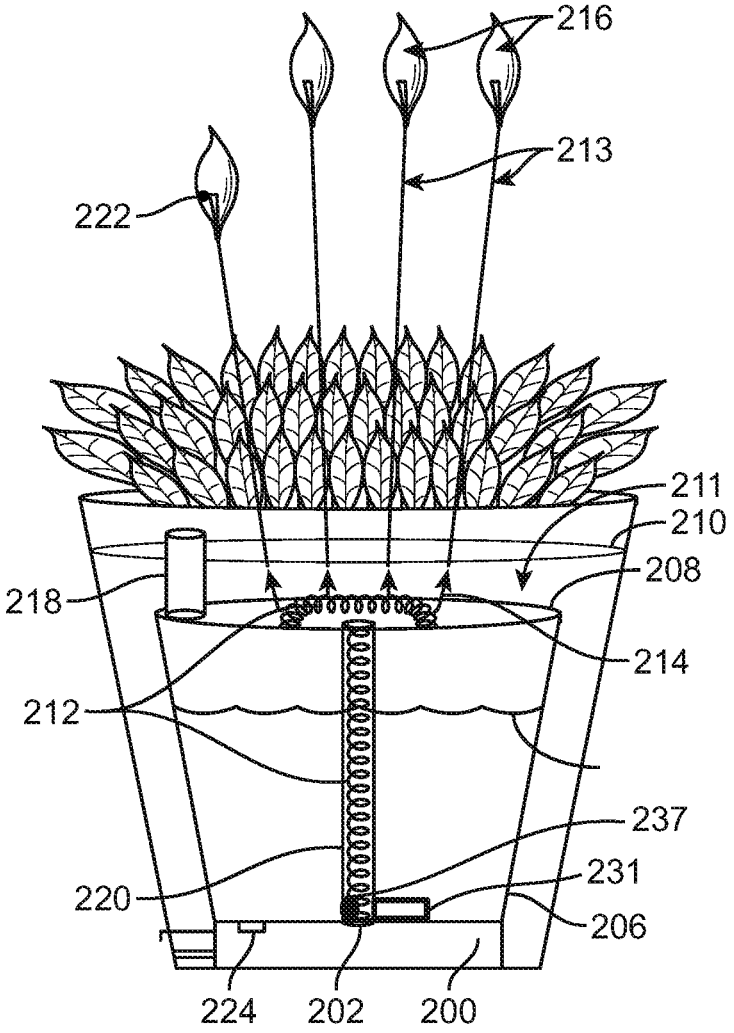
FIG. 2 is a cross sectional front view in accordance with an embodiment of the present disclosure.

FIG. 2 illustrates a cross-sectional view of artificial plant humidifier in accordance with an embodiment of present disclosure. The power base 200 houses the circuitry, which may include, but is not limited to, circuit boards and wireless communication devices, and electrical components which may include, but is not limited to, transformers, resistors and punch block(s). The power cord 110 and controls 112 (shown in FIG. 1) are connected to power base 200.

The humidification device 202 provides a means for vaporizing water and may be mounted to power base 200. The humidification device 202 may be an ultrasound generator, a heater, or other device to facilitate vaporization of water into a vapor pipe 220 according to the present disclosure, including combinations thereof. The humidification device 202 is in fluid communication with water reservoir 206. Water 204 may communicate gravitationally from the water reservoir to humidification device 202, whereupon water 204 is vaporized into vapor pipe 220.

The water reservoir may be inside base 102 which houses the humidification device 202. In one embodiment, water 204 will flow from the water reservoir 206 into a small channel 231 which will lead to the humidification device 202, creating a small amount of collected water 204 over the humidification device 202. The humidification device 202 will transform the liquid water 204 into a vapor, which will travel up the vapor pipe 220, which is surrounded by water reservoir 206. This vapor will collect into a vapor cavity 211 between the top of water reservoir 206 and the water vapor lid 208.

In one embodiment, the water vapor lid 208 may form a tight seal with the water reservoir 206 via a molded seal. The water reservoir 206 may have a raised ring around the perimeter. The water vapor lid 208 will have a corresponding double raised ring to seal around both sides of the water reservoir 206 perimeter ring. This will create a seal between the water reservoir 206 and the water vapor lid 208 to prevent water vapor from escaping. The weight of the water vapor lid 208 assembly will keep the seal tight.

The humid air will rise up and out of the vapor pipe 220 and up the stems 106 to the flowers 108 which comprise hollow water vapor conduit 213. The design of the channel 231 and water reservoir 206 automatically flow water as needed into the humidification device 202 without allowing the channel to overflow.

Water levels at the humidification device 202 may be regulated by a float in the vapor pipe 220 adjacent the humidification device. Other means of regulating water 204 levels at humidification device 202 may include a sensor 237 on an inner portion of the vapor pipe 220 which controls a valve in a channel 231 running from the water reservoir 206 to humidification device 202. Alternatively, a float in the water tank may self-regulate the water 204 level in the channel 231. A float in the channel 231 may regulate a valve in the water reservoir 206. A gravity feed system may be incorporated to self-regulate the water 204 level.

Water vapor may flow from humidification device 202 through vapor pipe 220 and hollow water vapor conduits 213 and into the surrounding environment without the need for mechanical force to propel the humidified air. In some embodiments, a means for forcing air may be employed to force air through vapor pipe 220 and hollow water vapor conduits 213.

Water reservoir 206 contains water 204 and sits on top of the power base 200. The water vapor lid 208 sits on top of the water reservoir 206 and forms a tight seal with water reservoir 206.

Referring again to FIG. 2, a decorative top 210 creates a visual barrier to conceal the water reservoir 206 and other components, while also giving artificial plant humidifier 100 a realistic appearance. Decorative top 210 may be artificial soil to mimic the appearance of soil. The artificial soil may be held together by an adhesive or other means of attachment, such that removal of decorative top 210 would not disturb the artificial soil.

Decorative top 210 provides a mounting point for leaves 104, stems 106, and flowers 108. In one embodiment, decorative top 210 and water vapor lid 208 may form an integral unit. In one embodiment, decorative top 210 may be separable from artificial plant humidifier 100 such that an alternative decorative top may be interchangeable with the original decorative top. An alternative decorative top may comprise a different type of artificial plant. When decorative top 210 is removed, leaves 104, stems 106, and flowers 108, may also be removed as they may be an integral unit. Stems 106 and flowers 108 are hollow to allow passage of water vapor. Additional items, which may include water vapor lid 208 and reservoir fill spout 218 may also be removed as an integral or combined unit. Reservoir fill spout 218 is mounted through the decorative top 210 to allow access when it is in place. Reservoir fill spout 218 aids in the filling of the large capacity water reservoir 206.

Water reservoir 206, containing water 204, sits on top of power base 200. Water 204 is fed from water reservoir 206 to humidification device 202. Upon water 204 entering humidification device 202, water vapor 212 is generated whereupon it travels up through vapor pipe 220. Once water vapor 212 has traveled through vapor pipe 220 and into water vapor cavity 211, it is contained by the water vapor lid 208. Water vapor 212 will then travel up stems 106 through hollow water vapor conduits 213 where it will eventually exit through flowers 108 at water vapor exit 216.

FIG. 2 further illustrates a notification light 222 which may also include a humidity sensor or other monitoring sensors, which may be housed in any leaves 104, stems 106, or flowers 108 of artificial plant humidifier 100. Notification light 222 may include an LED, fiber optic line or other lighting means, wherein notification light 222 is connected to power base 200 through an electrical connecting means, which may include electrical contacts, fiber optic line, conductive wire or additional means as would be known to one of ordinary skill in the art. The notification light 222 may illuminate to signal to a user relevant conditions within artificial plant humidifier, such as low water or low humidity. Notification light 222 may be visible or hidden when not illuminated.

FIG. 2 illustrates UV light 224. UV light 224 may be utilized to eliminate the growth of microbial organisms in water reservoir 206. UV light 224 may be tied into and draw power from power base 200. The design and location of UV light 224 within artificial plant humidifier 100 may vary based on the design of water reservoir 206 and/or surrounding components.

Figure 3:
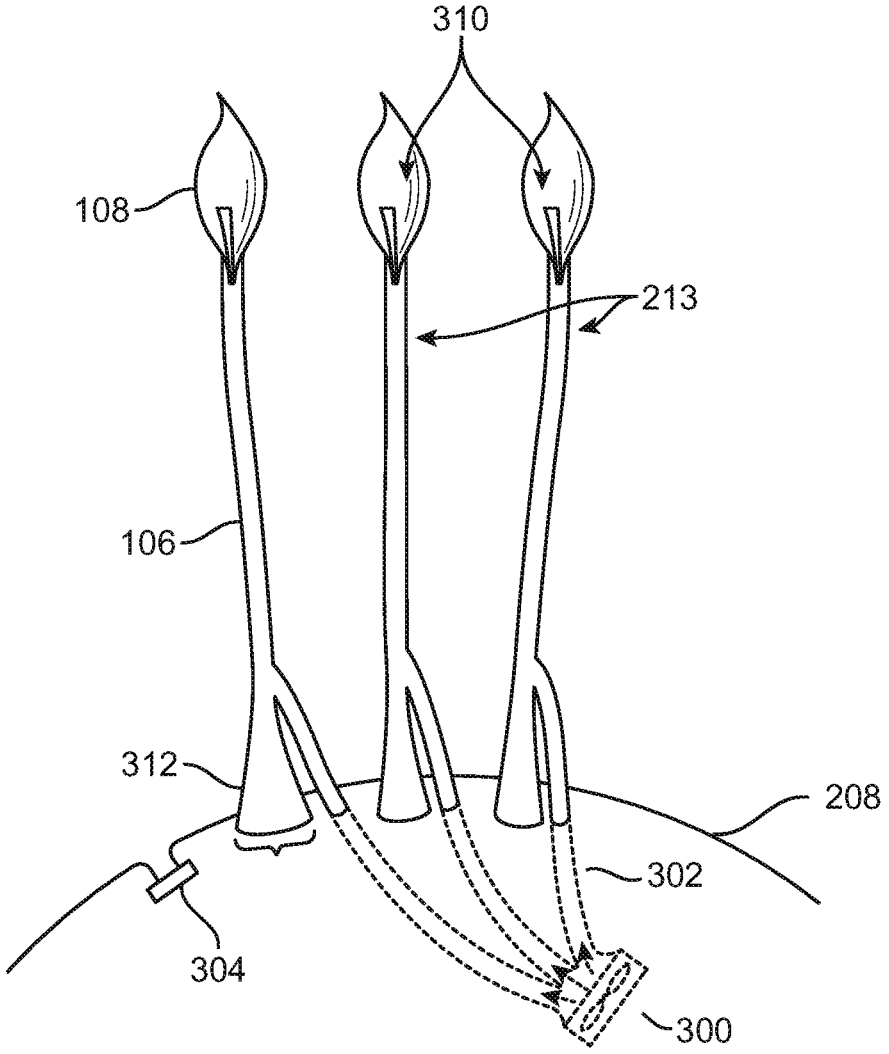
FIG. 3 is a perspective view of the drying system in accordance with an embodiment of the present disclosure.

FIG. 3 illustrates perspective view of the drying components of a drying system, in accordance with an embodiment of the present disclosure. Below water vapor lid 208 is drying fan 300. Drying air tubes 302 are connected to the drying fan 300 via a designed housing.

The drying system fits into the overall system below the decorative top. The fan is located below the vapor lid 208. The dry air intake valve 304 is located in the decorative top with a pass through the vapor lid in order to allow the passage of external air into the cavity under the vapor lid to feed the drying fan 300. This allows the aesthetics of the plant to remain intact at the decorative top and it allows the stem flare to be at the top of the vapor lid, adjacent a vapor entrance to the hollow water vapor conduit, capturing and funneling as much humidified air as possible and allowing for any condensed moisture within the hollow water vapor conduit to easily flow away from and out of the hollow water vapor conduit to prevent blockage and/or microbial growth.

Drying fan 300 is designed to dry stems 106 and flowers 108 after humidification has reached a desired level. Water buildup in the stems 106 and flowers 108 can cause blockage for future humidification, as well as the growth of microbial organisms. Drying fan 300 is configured to force a flow of air from the surrounding environment up through drying air tubes 302 and further up stems 106 to flowers 108. An intake valve 304 may be used to allow exterior drying air to enter the drying air tubes 302. The drying air tubes 302 connect into the stems 106 between the vapor lid 208 and the decorative top. Intake valve 304 may open during a drying cycle when drying fan 300 is programmed to run, thereby producing a flow of exterior drying air. The exterior drying air will allow for decreased pressure on the system of the otherwise sealed interior portion of artificial plant humidifier 100 and allow flow of exterior drying air through the system.

Exterior drying air flows from intake valve 304 to the drying fan 300. From here, the dry air will travel up through the stems 106 to the drying air exit 310 at flowers 108. The drying air 304 will dry stems 106 and flowers 108 and limit potential blockage and microbial growth.

FIG. 3 show stem flare 312. Stem flare 312 is designed to reduce accumulation of water in stems 106. Stem flare 312 creates a wider vapor tube proximal to water reservoir 206. Prior to the use of the drying fan 300, residual water droplets in stems 106 will flow downwards, due to gravity, back towards the water reservoir 206. Drying fan 300 may be programmed to begin running for a pre-determined period of time once room humidification has reached a pre-determined level and humidification device 202 is shut off in response to measurements by a humidification sensor in the artificial plant humidifier 100.

To reduce the potential for water droplet blockage, stem flare 312 will increase the surface area of the droplets to a size that their structure cannot withstand and the droplet will dissipate and fall, thus leaving stems 106 and stem flare 312 free from blockage. The design required for the stem flare 312 may vary, and the shape of the stem flare may be generally conical or toroidal.

Figure 4:
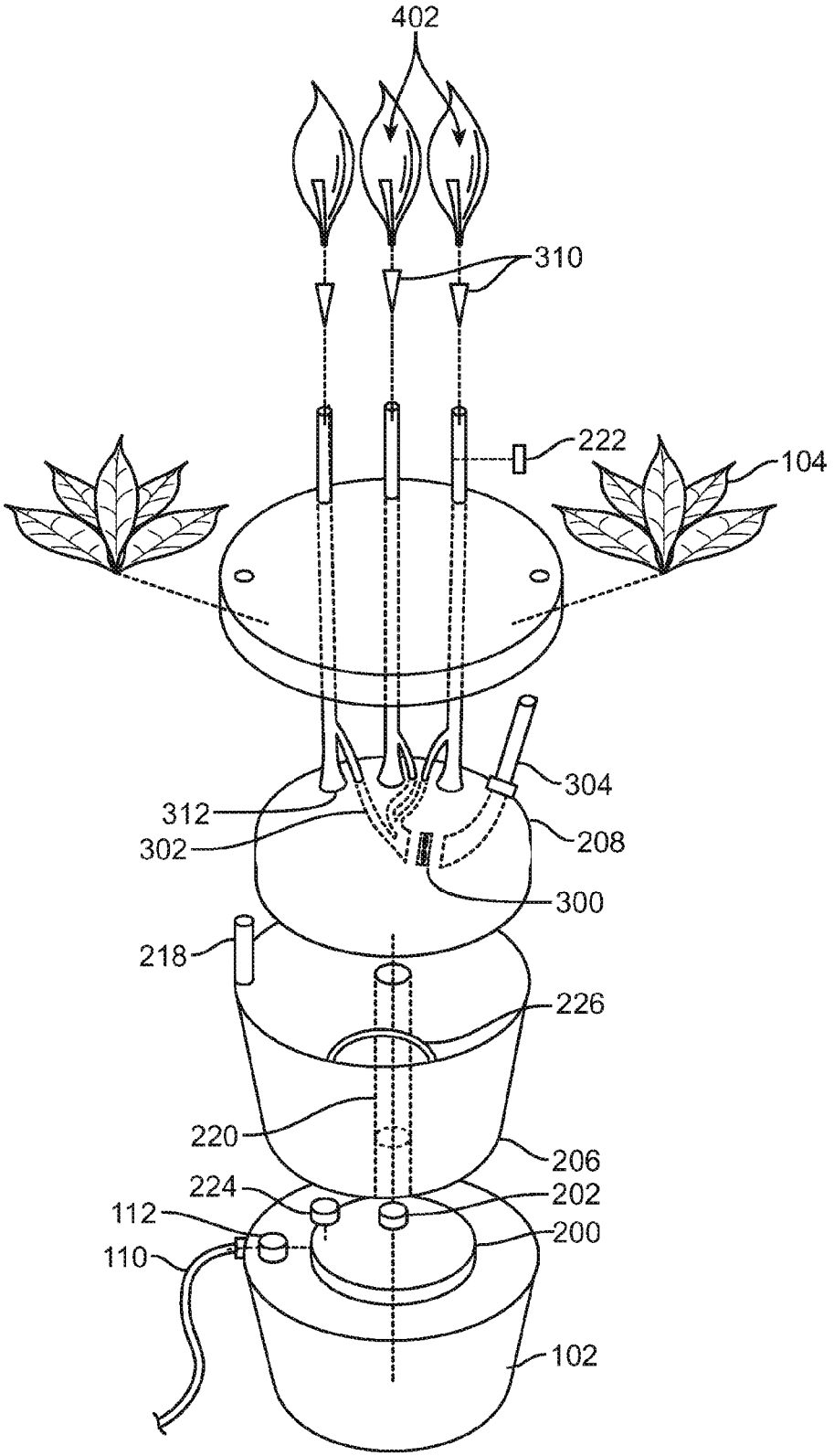
FIG. 4 is an exploded view of an artificial plant humidifier, in accordance with an embodiment of the present disclosure.

FIG. 4 shows an exploded view of the various parts of artificial plant humidifier 100. Handle 226 allows for lifting of water reservoir 206. Drying air tubes pass through vapor lid 208 and connect to intake valve 304, which is on the exterior side of vapor lid 208. Therefore, the fan 300 resides beneath vapor lid 208 and between vapor lid 208 and water 204.

Figure 5:
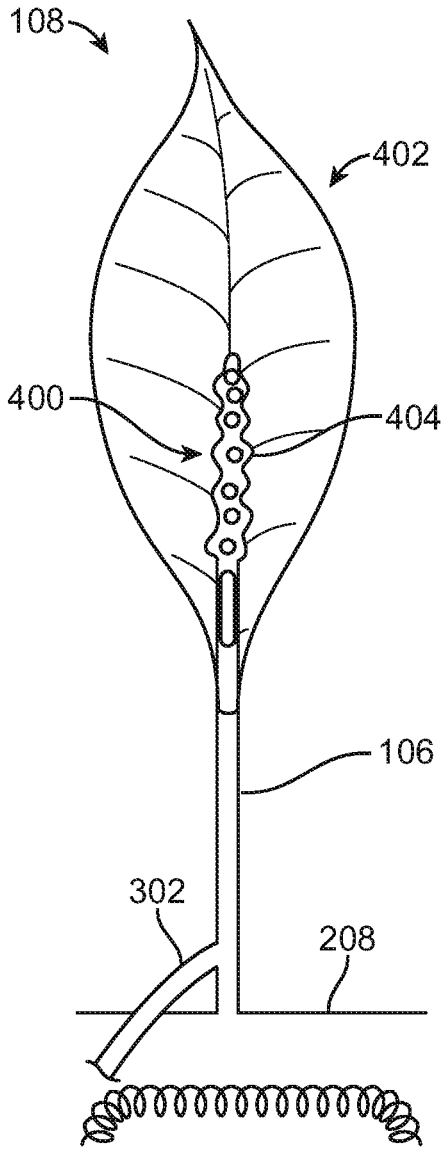
FIG. 5 is a front view of a plant flower, in accordance with an embodiment of the present disclosure.

FIG. 5 shows a flower 108, wherein water vapor exits the spadix 400 through water vapor exit apertures 404. Drying air may also exit through water vapor exit apertures 404. A peace lily is shown as a model plant in FIG. 5 and is preferable due to the presence of a spadix 400 and spathe 402. Spadix 400 refers to a spike of minute flowers closely arranged around a fleshy axis and typically enclosed in a spathe 402. A spathe 402 refers to a large sheathing bract enclosing the flower cluster of certain plants. Spadix 400 is preferable for the purposes of the present disclosure because apertures can be placed on or between extensions on the surface of spadix 400, or at the tips of the extensions on spadix 400, while remaining inconspicuous. A spadix 400 is a preferred feature for water vapor exit apertures 404 due to its relatively large surface area and the ability to conceal water vapor exit apertures 404 due to its rough surface.

FIG. 5 shows a stem 106 and a flower 108, which comprises the spadix 400 and the spathe 402. One with skill in the art will understand the designations spadix and spathe may refer to a limited number of plants and flowers, however the use of various alternative plants and flowers may be within the scope of the present disclosure. Preferable for the purposes of the present disclosure may be flowers having heads comprised of disk flowers and ray flowers, where the disk flower portion may be used to contain and conceal water vapor exit apertures 404. The disk flower portion of a flower head, for example, would be the central portion of a daisy or sunflower head.

Spadix 400 will have water vapor exit apertures 404 for water vapor exit 216 and the exterior drying air exit 310. Spathe 402 serves as a realistic decorative embellishment for the artificial plant humidifier as described. The stem may rise to a level at least 12 inches from the soil, or a level such that the humidification will not collect or condense on the lower portion of the unit. Water vapor 212 will follow the water vapor path 214 up through stems 106 and out through spadix 400, via the water vapor exit 216, to humidify the surrounding environment.

Figure 6:
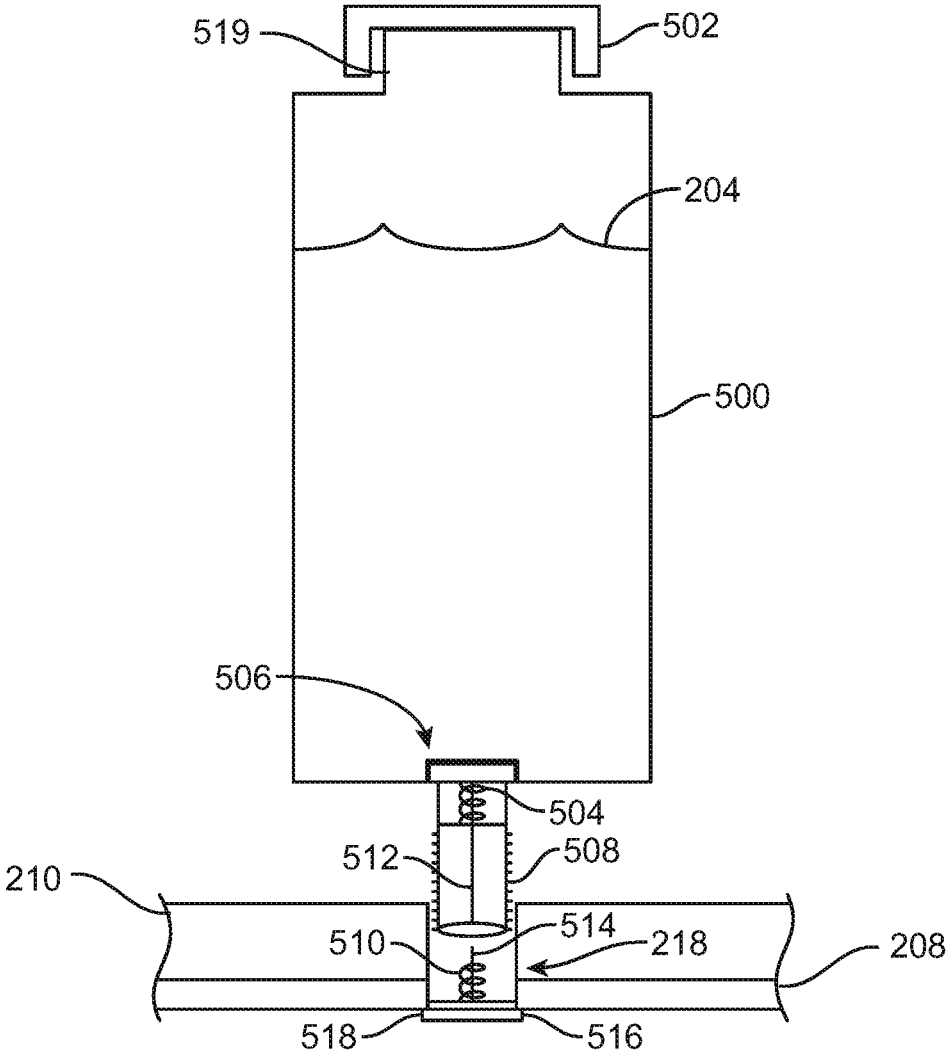
FIG. 6 is a cross sectional view of a reservoir fill bottle system, in accordance with an embodiment of the present disclosure.

FIG. 6 illustrates reservoir fill bottle 500, in accordance with an embodiment of the present disclosure. The reservoir fill bottle 500 is designed to ease the task of filling the water reservoir 206 of artificial plant humidifier. Due to the large size of the water reservoir 206, moving artificial plant humidifier 100 during filling would be difficult. However, the large capacity of artificial plant humidifier 100 allows for longer continuous run times when compared to conventional humidifiers. The design of reservoir fill bottle 500 allows for filling of water reservoir 206 without moving or disassembling artificial plant humidifier 100, while allowing for continuous operation.

Reservoir fill bottle 500 has a reservoir fill bottle cap 502 and a fill bottle spout 519. Fill bottle seal 506 prevents spillage of water 204. To fill water reservoir 206 fill bottle threaded end 508 is screwed into the reservoir fill spout 218 (shown in FIG. 2). Upon connecting fill bottle threaded end 508, reservoir plunger 514 is depressed first, thus opening the reservoir seal 516. Reservoir seal 516 is normally held closed by reservoir spring 510. Secondly, fill bottle plunger 512 is depressed, opening the fill bottle seal 506, which is held closed by fill bottle spring 504 during operation. Water 204 then flows through fill bottle water exit 518 and fills water reservoir 206.

When water 204 completely fills water reservoir 206, or the reservoir fill bottle 500 empties, reservoir fill bottle 500 can be unscrewed. Upon unscrewing reservoir fill bottle 500, due to the design, fill bottle seal 506 will be set in place first, stopping the flow of water 204 from fill bottle water exit 518. The reservoir seal 516 will be held open longer allowing complete drainage of the reservoir fill spout 218 via the reservoir fill flow. This prevents stagnant water buildup in the reservoir fill spout 218 over time and possible spillage.

The reservoir fill bottle 500 will further be designed such that the fill bottle spout 519 is of a different diameter than the fill bottle threaded end 508 in order to prevent any spilling caused by utilizing the reservoir fill bottle 500 upside-down. One skilled in the art will appreciate the ability to design the fill bottle spout 519 larger or smaller than the fill bottle threaded end 508 with no alteration to the design or effectiveness of any component of artificial plant humidifier to achieve the described function of spill-reduction.

Additional embodiments and variations, as based on the aforementioned descriptions and accompanying figures, may be appreciated by one skilled in the art. One such embodiment may be the ability to create interchangeable bases 102 for use with artificial plant humidifier 100. This would allow owners and users to alter the look of their artificial plant humidifier at any time. In addition, an embodiment contemplated within the scope of the present invention is the use of interchangeable decorative tops 210, which may contain leaves 104, stems 106 and flowers 108 of various colors, styles, quantity, and variety.

Although the disclosure has been described with reference to certain preferred embodiments, it will be appreciated by those skilled in the art that modifications and variations may be made without departing from the spirit and scope of the disclosure. It should be understood that applicant does not intend to be limited to the particular details described above and illustrated in the accompanying drawings.

What is claimed is:

1. A humidifier, comprising:

a base, a water reservoir contained within the base for holding a supply of water to be evaporated;

a humidification device attached to the base in communication with the water reservoir;

a vapor pipe in communication with the humidification device;

at least one hollow water vapor conduit in communication with the vapor pipe, wherein the at least one hollow water vapor conduit is comprised of a hollow stem and a hollow flower;

wherein the hollow flower has at least one vapor exit aperture; wherein the at least one aperture comprises a vapor exit for transmitting water vapor to the surrounding environment.

2. The humidifier of claim 1, wherein the at least one hollow water vapor conduit is integral with a vapor lid, wherein the vapor lid is integral with a portion of a replica of a plant; wherein the replica of the plant further comprises a plurality of leaves surrounding at least one hollow stem and at least one hollow stem; wherein the replica of the plant is integral with a decorative top;

wherein the vapor lid is removably attached to the base.

3. The humidifier of claim 2, wherein the base simulates a planter; wherein the decorative top has on an artificial soil portion.

4. The humidifier of claim 2, wherein the hollow stem has a length of between 24 and 40 inches and the hollow stem has an interior diameter of approximately between ⅜ and ½ of an inch.

5. The humidifier of claim 1, wherein the vapor pipe is in communication with a vapor cavity; wherein the vapor cavity is in communication with the at least one hollow water vapor conduit; wherein the at least one hollow water vapor conduit is integral with the vapor lid.

6. The humidifier of claim 1, further comprising a means to force water vapor through the vapor pipe in a generally vertical direction.

7. The humidifier of claim 1, wherein the at least one hollow water vapor conduit has a first and a second end, wherein the first end has a vapor entrance, wherein the vapor entrance is flared such that the at least one hollow water vapor conduit widens as it becomes closer in proximity to the water reservoir.

8. The humidifier of claim 1, wherein the at least one hollow water vapor conduit has a first and a second end, wherein the first end is has a vapor entrance, wherein the vapor entrance is flared in a toroidal shape, such that vapor pipe narrows in the direction of the vapor exit.

9. The humidifier of claim 1, wherein the at least one hollow water vapor conduit is coated with a hydrophobic substance.

10. The humidifier of claim 1, further comprising at least one drying air tube each having a first end and a second end, wherein the first end of the at least one drying air tube is sealably connected to a drying air fan, wherein the second end of each drying air tube opens into a corresponding hollow water vapor conduit at a location directly adjacent a flared region.

11. The humidifier of claim 1, wherein the drying air fan communicates with a humidity sensor, which in turn communicates with the humidification device, such that the drying air fan begins operating upon termination of operation of the humidification device in response to the humidity of the surrounding environment reaching a pre-determined level according to the humidity sensor.

12. The humidifier of claim 2, wherein the at least one vapor tube is substantially concealed by the decorative top.

13. The humidifier of claim 2, wherein the plant has a spadix and a spathe; wherein the at least one vapor exit aperture is contained in at least one of the spadix and spathe.

14. The humidifier of claim 13, wherein the plant has a plurality of hollow water vapor conduits and is a peace lily.

15. A humidifier, comprising:

a base, a water reservoir contained within the base for holding a supply of water to be evaporated;

a humidification device attached to the base in communication with the water reservoir;

a vapor pipe in communication with the humidification device;

at least one hollow water vapor conduit in communication with the vapor pipe, wherein the at least one hollow water vapor conduit is comprised of portions of an artificial plant; wherein at least one hollow water vapor conduit terminates at a vapor exit aperture; wherein the at least one aperture comprises a vapor exit, such that water vapor is transmitted to the surrounding environment;

wherein the at least one hollow water vapor conduit is integral with a vapor lid, which is integral with a portion of a replica of a plant; wherein the replica of the plant further comprises a plurality of leaves surrounding at least one hollow stem and at least one hollow stem; wherein the replica of the plant is integral with a decorative top;

wherein the humidification device is an ultrasonic generator; wherein water from the water reservoir flows through a channel to collect on an upper portion of the ultrasonic generator;

at least one drying air tube each having a first end and a second end, wherein the first end of the at least one drying air tube is sealably connected to a drying air fan, wherein the second end of each drying air tube opens into a corresponding hollow water vapor conduit at a location directly adjacent a flared region;

wherein the drying air fan communicates with a humidity sensor, which in turn communicates with the humidification device, such that the drying air fan begins operating upon termination of operation of the humidification device in response to the humidity of the surrounding environment reaching a pre-determined level according to the humidity sensor;

wherein the drying air fan is in communication with a drying air valve adjacent the vapor lid.

16. The humidifier of claim 15, wherein the decorative top has a reservoir fill bottle spout in the water vapor lid and decorative top, configured such that a reservoir fill bottle may be removably attached to the decorative top to refill the water reservoir.

17. The humidifier of claim 16, wherein the reservoir fill bottle spout achieves fluid communication with water in the reservoir fill bottle upon depression of a fill bottle plunger while the reservoir fill bottle is being screwed into the reservoir fill bottle spout.

18. A humidifier, comprising:

a base, a water reservoir contained within the base for holding a supply of water to be evaporated;

a humidification device in communication with the water reservoir;

at least one hollow water vapor conduit, wherein the at least one hollow water vapor conduit is comprised of a portion of an artificial plant; wherein the hollow water vapor conduit has at least one vapor exit aperture; wherein the at least one aperture comprises a vapor exit, such that water vapor is transmitted to the surrounding environment.

19. The humidifier of claim 18, wherein the hollow water vapor conduit is a component of a decorative top; wherein the decorative top is a replica of a plant; wherein the decorative top is connected to the water reservoir; wherein the base is a replica of a planter; wherein the base and decorative top combine to give an appearance of a potted plant.

20. The humidifier of claim 5, wherein a notification light is included in a portion of the artificial plant.

* * * * *